US007874799B2

(12) United States Patent
Young et al.

(10) Patent No.: US 7,874,799 B2
(45) Date of Patent: Jan. 25, 2011

(54) FLOW CAVITY ARRANGEMENT

(75) Inventors: Colin Young, Derby (GB); Guy D. Snowsill, Derby (GB)

(73) Assignee: Rolls-Royce plc, London (GB)

( * ) Notice: Subject to any disclaimer, the term of this patent is extended or adjusted under 35 U.S.C. 154(b) by 730 days.

(21) Appl. No.: 11/905,463

(22) Filed: Oct. 1, 2007

(65) Prior Publication Data

US 2008/0310950 A1 Dec. 18, 2008

(30) Foreign Application Priority Data

Oct. 14, 2006 (GB) ..... 0620430.9

(51) Int. Cl.
*F01D 5/08* (2006.01)
*F01D 5/18* (2006.01)

(52) U.S. Cl. ..... 416/97 R; 415/115; 415/173.7; 415/174.4; 415/174.5; 416/96 R

(58) Field of Classification Search ..... 415/110–112, 415/115, 116, 173, 7, 174.4, 175.5; 416/96 R, 416/96 A, 97 R, 95
See application file for complete search history.

(56) References Cited

U.S. PATENT DOCUMENTS 3,635,586 A * 1/1972 Kent et al. ..... 416/97 R
3,989,410 A * 11/1976 Ferrari ..... 415/115
4,291,531 A * 9/1981 Campbell ..... 416/95
4,425,079 A * 1/1984 Speak et al. ..... 415/139
4,466,239 A * 8/1984 Napoli et al. ..... 415/116
5,402,636 A * 4/1995 Mize et al. ..... 415/115
5,800,125 A * 9/1998 Largillier et al. ..... 416/96 R
6,551,056 B2 * 4/2003 Rau ..... 415/115
6,773,225 B2 * 8/2004 Yuri et al. ..... 415/1
6,787,947 B2 * 9/2004 Coulon et al. ..... 416/95
6,837,676 B2 * 1/2005 Yuri et al. ..... 415/115
7,048,497 B2 * 5/2006 Arilla et al. ..... 415/116
2004/0247429 A1 12/2004 Arilla et al.

FOREIGN PATENT DOCUMENTS

EP 0 926 315 A3 6/1999
GB 1 268 301 A 3/1972
GB 2 032 531 A 5/1980
GB 2 426 289 A 11/2006

* cited by examiner

*Primary Examiner*—Igor Kershteyn
(74) *Attorney, Agent, or Firm*—Oliff & Berridge, PLC

(57) ABSTRACT

It is known with regard to particularly cavities below high pressure turbine discs that mixing of hot gas leakage flows through an inner seal with cooling flows can diminish the effectiveness of that cooling flow when presented to other parts for cooling. By providing a path within a wall which is particularly shaped in portions it is possible to provide entrainment of a hot leakage gas flow away from entry into the cavity. Thus, the cooling flow retains a higher cooling effect and maintains its swirling nature in comparison with prior arrangements where mixing with the hot leakage flow occurred.

16 Claims, 4 Drawing Sheets

FLOW CAVITY ARRANGEMENT

The present invention relates to flow in rotor-stator cavity arrangements and more particularly to flow in the rotor-stator cavity arrangements in gas turbine engines such as with respect to the turbine disc mounting arrangements in such gas turbine engines where a coolant flow is arranged to wash over parts of the turbine disc to cool those components exposed to high temperatures.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

In view of the above it will be appreciated that the turbines 16, 17, 18 and in particular the turbine blades which are mounted upon turbine discs will be subjected to high temperatures. In order to extend component life and operability coolant flows will be provided to ensure these components remain within acceptable temperature limits. Unfortunately, in order to accommodate for rotation as well as thermal expansion tight sealing is not generally applicable and therefore labyrinth type seals are utilised such that there is leakage of hot gas. Mixing of hot gas with coolant flows will inherently increase the temperature of those coolant flows and therefore diminish the efficiency of the coolant flow with respect to the cooling effect on components.

FIG. 2 illustrates a typical prior cavity arrangement in a gas turbine engine in which a combustor casing 30 includes a wall 31 presenting a coolant outlet nozzle 32 which pre swirls a coolant flow A into a cavity 33 formed by the wall 32 and an opposed turbine disc 34. A coolant bleed flow aperture 40 is provided in the turbine disc 34, and through which a coolant flow Am flows from the cavity 33. The turbine disc 34 incorporates labyrinth seal elements 35, 36 which act with opposing parts of the arrangement in order to create cavity or chamber seals 38, 39. As indicated above, inherently the seals 38, 39 are subject to leakage such that high temperature gas in the direction of arrowheads B passes into the cavity 33. Generally, as illustrated, the seals 38, 39 are located radially inwardly and outwardly of the cavity 33 respectively, and present this leakage across an opening 37 of the nozzle 32 such that flows A and B mix intimately. Thus, a coolant flow Am is inherently a mixture of the initial coolant flow A presented through the nozzle 32 and at least a proportion of the hot leakage gas B such that the temperature of the coolant flow Am is higher than would be desirable or possible if more limited to flow A alone.

The configuration depicted in FIG. 2 is determined by engine design constraints as indicated by the necessity for having labyrinth seals 38, 39. By such an arrangement delivery of relatively hot leakage flows B is inherent. The coolant flow A in the form of secondary air is generally delivered to the cavity 33 as indicated via nozzles 32 which are angled toward a tangent (i.e. into or out of the page) to provide a circumferential pre swirl effect. In such circumstances there is a high fluid velocity prevailing within the cavity 33 such that vigorous mixing of the flows A, B occurs. Thus, the presented coolant flow Am has a higher temperature and lower swirl velocity than provided initially from the nozzles 32 into the cavity 33. Such effects, that is to say higher temperature and lower swirl velocity, diminish the cooling efficiency of the coolant flow Am delivered to the rotating blades and other parts of the engine. It is clearly desirable to provide as cool a coolant flow Am as possible such that the hot leakage flow is detrimental to the cooling efficiency of the coolant flow Am.

In accordance with aspects of the present invention there is provided a flow cavity arrangement for a gas turbine engine, the arrangement comprising a cavity defined between a static member and a rotor which also form seals therebetween, the static member comprises a wall defining a nozzle opening for providing a coolant flow into the cavity the rotor member defines a coolant bleed aperture, a leakage flow passes through a seal into the cavity and is directed at the wall, the arrangement characterised in that the wall includes a path to divert the hot leakage flow away from the nozzle opening and prevent significant mixing of the coolant flow and leakage flow.

Preferably, the path comprises a passage below the wall surface.

Preferably, the passage is integral with the wall and may be formed between a plate and a section of the wall to which it is secured.

Preferably, the wall includes a diverter to divert leakage to the path. The diverter may comprise a curved portion of the cavity adjacent to the path.

Preferably, the path includes a curved portion at its entrance to direct leakage flow in use.

Alternatively, the wall incorporates at least one fence, and the fence may comprise a curved portion to turn the leakage flow in a radial direction.

Preferably, the wall incorporates a plurality of paths.

Preferably, the cavity includes a coolant bleed aperture.

Preferably, the path includes an exit away from the coolant bleed aperture.

Alternatively, the path extends laterally across the wall.

Preferably, the nozzle opening is part of a nozzle to provide swirl for a coolant flow in use.

Preferably, the wall forms part of an engine core.

Preferably, a gas turbine engine includes a flow cavity arrangement as described in the above paragraphs.

Figure 1:
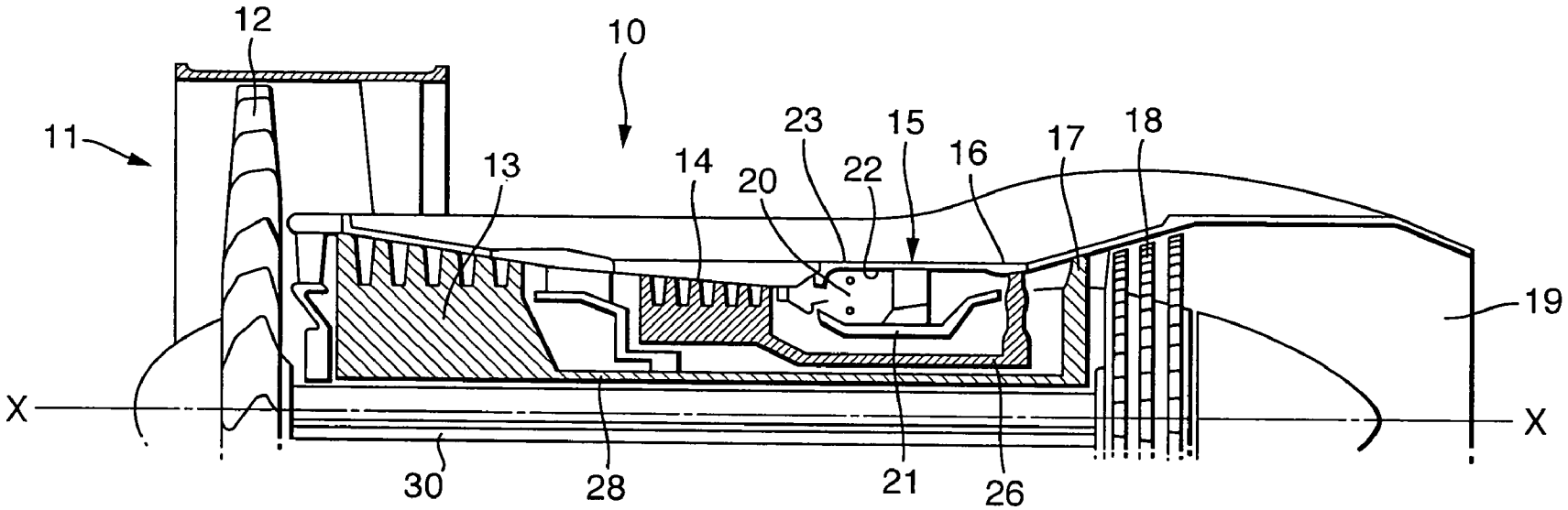
FIG. 1 is a schematic section through part of a conventional gas turbine engine.
Figure 2:
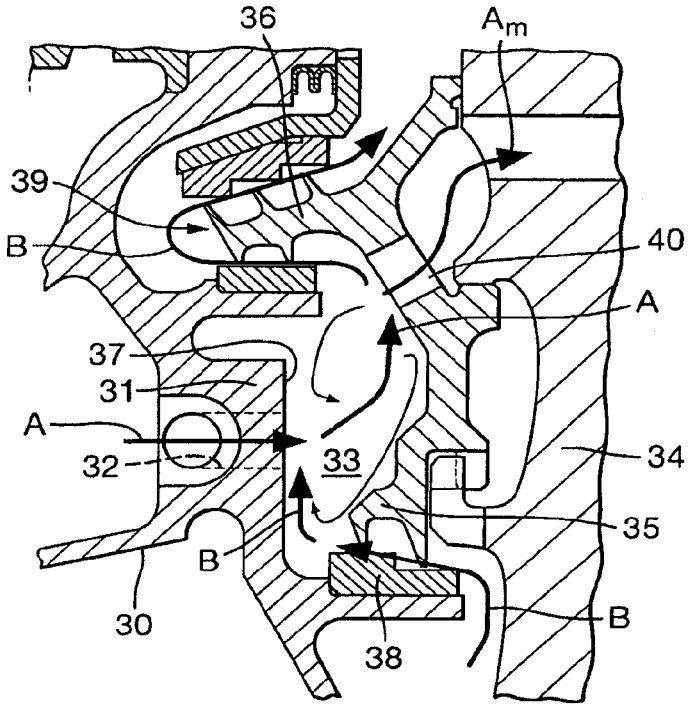
Prior Art Fig.2.
FIG. 2 is a section through a prior art turbine of the gas turbine engine showing a cavity sealing and airflow arrangement.
Figure 3:
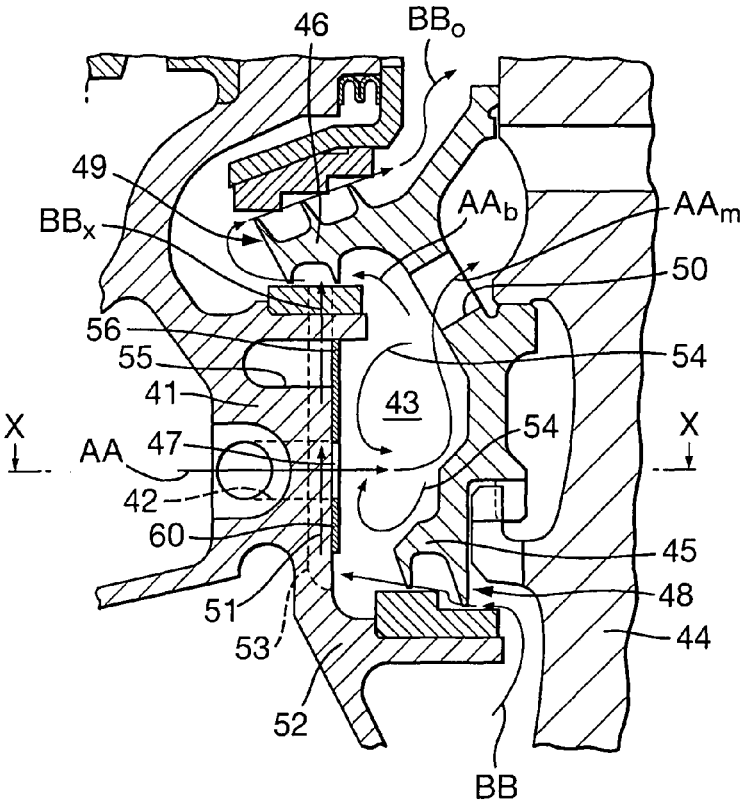
FIG. 3 is a schematic cross section of a flow cavity arrangement in accordance with the present invention.
Figure 4:
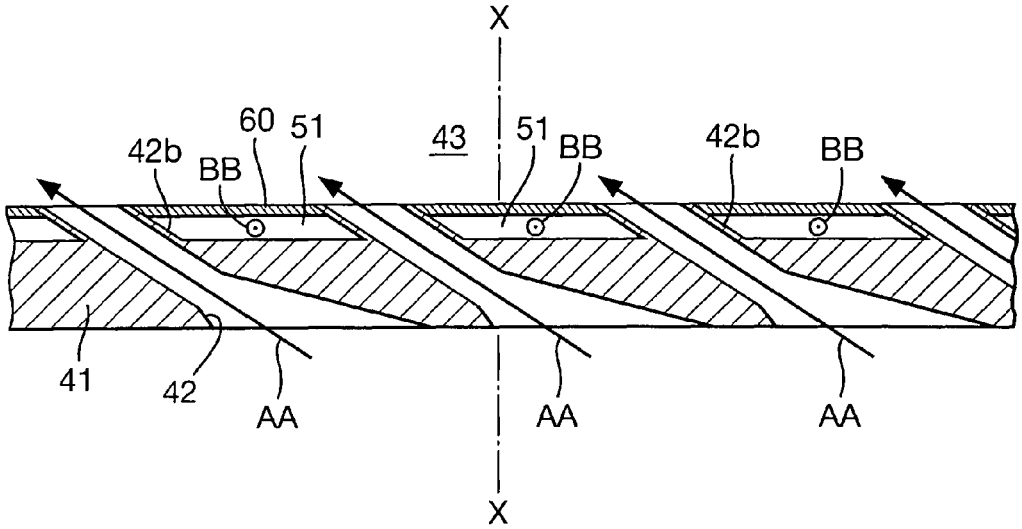
FIG. 4 is a section XX in FIG. 3 of the flow cavity arrangement in accordance with the present invention.

An embodiment of the present invention will now be described by way of example and with reference to FIG. 3 depicting a schematic cross section of a flow cavity arrangement and FIGS. 4 and 5 in accordance with aspects of the present invention.

As indicated above, a reduction in the effectiveness of cooling air delivered to components such as the high pressure turbine cavity surfaces can result in such components being exposed to proportionally increased operating temperatures relative to what would be desirable or tolerable. It will be understood that the safe operating life of rotating components is strongly linked to the temperature at which those components operate such that even relatively modest reductions in operating temperature can cause significant increases in the effective operational life of a component.

In view of the above, mixing of air intended for cooling with hot leakage gases to cause an increase in the temperature of that cooling air as well as reduction in swirl is detrimental. In such circumstances separation of the hot leakage gas entering a cavity from air intended for cooling in order to maintain a lower temperature cooling air flow as well as a higher level of swirl would be beneficial. Thus, as previously, a cavity 43 is provided and formed by a static member in the form of a wall portion 41 (of a combustor casing in this embodiment) including a nozzle 42 with an opening or outlet 47 opposing a rotating member in the form of a turbine blade disc 44. The cavity 43 is further defined by radially inner and out seals 48, 49 respectively comprising seal portions 45, 46 opposing other parts of the assembly. The seals 48, 49 are formed between the static member 41 and the rotating member 44.

In such circumstances as previously, a coolant flow AA passes into the cavity 43 and is presented through a coolant bleed aperture 50 to provide cooling around the turbine blade disc 44 and other components. As previously, a hot secondary or leakage flow BB passes an inner seal 48 into the cavity 43.

In accordance with aspects of the present invention the hot gas leakage BB is diverted by a path 51 defined within or as part of the wall portion 41 such that it is separated, and ideally isolated, from the cooling flow AA so reducing mixing with that flow AA as well as reducing any retardation of swirl within the cavity 43. In such circumstances the cooling flow AAm presented to the turbine blade disc 44 and other components is markedly cooler than previously where mixing with hot gas leakage caused a rise in the presented temperature of the flow AAm.

The path 51 is generally located below the surface of the wall portion 41. The path 51 takes the form of a passage which can be integrally formed with the wall portion 41 or a separate plate 60 secured to the wall portion 41. In either event normally to facilitate diversion of the flow BB the cavity 43 in a portion 52 adjacent to the path 51 as well as an entrant portion 53 of the path 51 is shaped to take the flow BB leakage through the seal 48 into the path 51 rather than entering the cavity 43, or at least a greater proportion into the path 51.

In the above circumstances it will be seen that the leakage flow BB is routed though the cavity arrangement 40 such that it is isolated from the flow AA. Generally, as depicted, the nozzle 42 will be substantially perpendicular to the path 51 and separate. In such circumstances although there may be thermal conduction between the nozzle 42 and the path 51, there will be limited thermal exchange and therefore heating of the flow AA entering the cavity 42.

As indicated above in accordance with aspects of the present invention, the hot leakage flow BB is substantially captured within the path 51. Typically, the leakage BB will have a relatively high axial (right to left on FIG. 3) and tangential (into or out of the page on FIG. 3) velocity, possibly in the order of 120 m per second. In such circumstances by providing curvature and shaping to the portions 52, 53 this leakage flow BB can be turned by these static features from a substantially axial and tangential direction to a radial direction through the path 51.

It will also be understood that generally the cooling flow AA may create secondary air pressure within the cavity 42 causing secondary air flows and swirls 54 which will act to again "squeeze" the flow BB into the path 51. It will also be understood that the pressure in cavity 42 is higher than that outboard of the outermost seal 49 leading to a cooling flow AAb which will urge the exiting flow BBx outwardly and away from the bleed aperture 50 for coolant flow AA. In such circumstances any exit 55 for the path 51 will be remote from the bleed aperture 50 and therefore again will avoid increase in the temperature and diminution of the swirl of the flow AAm provided for cooling effect.

It will be understood that the path 51 essentially acts as a bypass passage for the cavity 43 and the nozzle 42 passes to the side or across of that path 51.

It will be understood in a practical arrangement, which is generally an annular construction there will be provided with a number of nozzles 42, in the form of bosses 42*b*, extending into the annular cavity 43 about which the high pressure turbine disc 44 is located. In such circumstances there will be a plurality of paths 51 or an annular path 51 supported and spaced by the bosses 42*b* in order to facilitate bypass of the hot gas and significantly diminish the leakage flow BB entering the cavity 43. It will also be understood that, as indicated, entry portions 53 of the path 51 may be shaped to facilitate entrainment of the leakage flow BB by curving and a funnel or scoop effect.

The exiting leakage flow BBx as indicated will generally be presented perpendicularly from the exit 55 of the path 51. Thus, as indicated above, a portion AAb of the cooling flow AA will mix with the leakage flow BBx with a lateral impingement angle to cause a combined flow BBo which will pass over the outer seal 49. In any event, the effect of the flow AAb will be to ensure that the flow BBx is discouraged from mixing with the flow AAm and increasing its temperature and reducing its swirl.

By the above aspects of the present invention it will be understood that relatively hot leakage gas BB entering the cavity 43 via the seal 48 is separated and substantially isolated from the cooler flow AA reducing its temperature elevating effects and avoiding disruption of swirl. The hotter leakage gas flow BB is further guided through the path 51 and urged over the outer seal 49. In such circumstances the potential cooling effects of the cooling flow AA are more fully utilised in cooling components about the arrangement 40. In such circumstances it is possible that the cooling flow AAm will have a significantly lower temperature than previous arrangements. This lower temperature may be lower than the prior art arrangement by about 20K, which results in a greater component life on a like for like basis or could allow a reduction in the flow AA improving the efficiency of an engine incorporating a flow cavity arrangement 40 in accordance with the present invention. The choices available are a balance between extended component life and a reduction in cooling flow requirements. It will be understood that cooling flow requirements are a parasitic effect on the thermal efficiency of an engine incorporating an arrangement in accordance with aspects of the present invention. Thus by reducing the amount of coolant flow required there can be a reduction in fuel consumption.

The path 51, in accordance with the present invention, may be provided in a number of ways. As indicated it may be substantially straight and radial or angled in order to again facilitate entrainment of the leakage flow BB to inhibit entry to the cavity 43. Furthermore, the passage may be shaped to achieve effective bypass of the hot gas flow. Generally, it is desirable that the path 51 as indicated comprises a passage extending beneath a surface 56 of the wall portion 41 within which the outlet 47 of the nozzle 42 is presented. The path 41 may be created as a plate 60 secured to a base wall portion or the path in the form of a passage may be drilled or otherwise provided within the wall portion as necessary. Generally, the path 51 will be constructed to ensure preferential entrainment of the flow BB in order to bypass the cavity 43. In such circumstances the path 51 will be constructed to facilitate that preferential entrainment of the leakage flow BB whilst being readily achievable in terms of cost, manufacture and/or assembly.

Although described principally with regard to high pressure turbine discs, it will be understood that cavity flow arrangements in accordance with aspects of the present invention may be utilised in other areas of a gas turbine engine such as the intermediate and low pressure turbine discs of an engine or other situations where separation and isolation of flows is required. Thus, it may be desirable to isolate and separate the gases of different species presented to a cavity in accordance with aspects of the present invention. As indicated, the cavity 43 in accordance with aspects of the present invention is generally provided to allow the cooling flow AA to swirl and therefore be appropriately presented for cooling effect with regard to components. However, the leakage flow BB is inherent in view of the necessary construction for an engine and its operation such that this hot gas or other gas species will be presented to the swirling cavity. The present invention provides for a means to allow substantial isolation between the respective flows at relevant positions or parts of the cavity and therefore to maintain the efficiency of the primary cooling flow AA entering the cavity to achieve its objective. The different gas flows AA, BB may, as indicated, have different thermal conditioning or composition dependent upon requirements.

It will be understood that the path 51 acts as indicated to bypass the cavity 43. In such circumstances as indicated a number of configurations for the path 51 can be achieved and limitation will generally be in terms of potential manufacturing capability and costs. Nevertheless, it will also be understood that the portions 52, 53 may be extended and in particular an inner part of the wall surface 56 adjacent to the entry portion 53 extended in order to again facilitate entrainment of the leakage flow BB to inhibit hot leakage gas flow into the cavity 43.

Figure 5:
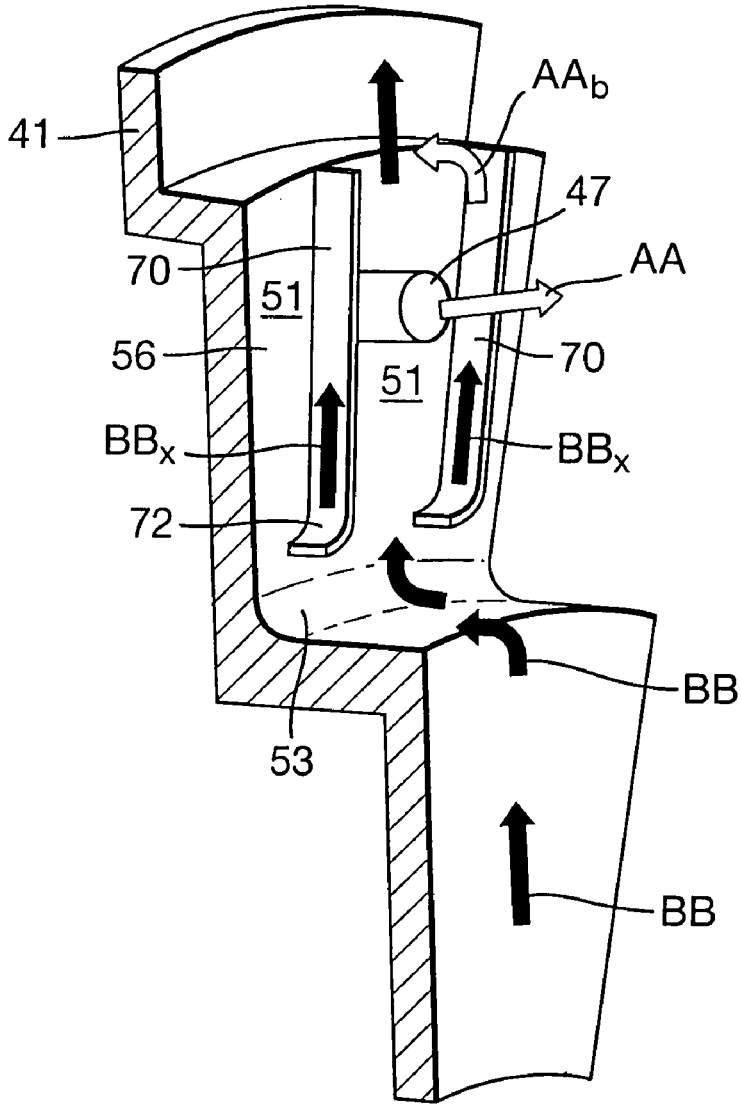
FIG. 5 is a perspective view of a cut-away of the flow cavity arrangement in accordance with the present invention.

In FIG. 5, which is a perspective view of the static wall portion 41 with the plate 60 removed, the portions 52, 53 may comprise radially extending fences 70 that partly define the path(s) 51. The fences 70 comprises an arcuate portion 72 at their radially inner end. The arcuate portion 72 acts to collect and turn the flow BB, which may have a tangential component to its flow from the radially inner seal 48, in a radially outward direction. The curved part 53 of the radially inner part of the wall 56 turns the flow BB from an axial direction into a radially outward direction.

We claim:

1. A flow cavity arrangement for a gas turbine engine, the arrangement comprising a cavity defined between a static member and a rotor which also form seals therebetween, the static member comprises a wall defining a nozzle opening for providing a coolant flow into the cavity the rotor member defines a coolant bleed aperture, a leakage flow passes through a seal into the cavity and is directed at the wall, the arrangement characterised in that the wall includes a path to divert the hot leakage flow away from the nozzle opening and prevent significant mixing of the coolant flow and leakage flow.

2. An arrangement as claimed in claim 1 wherein the path comprises a passage below the wall surface.

3. An arrangement as claimed in claim 2 wherein the passage is integral with the wall.

4. An arrangement as claimed in claim 2 wherein the passage is formed between a plate and a section of the wall to which it is secured.

5. An arrangement as claimed in claim 1 wherein the wall includes a diverter to divert leakage to the path.

6. An arrangement as claimed in claim 5 wherein the diverter comprises a curved portion of the cavity adjacent to the path.

7. An arrangement as claimed in claim 1 wherein the path includes a curved portion at its entrance to direct leakage flow in use.

8. An arrangement as claimed in claim 1 wherein the wall incorporates at least one fence.

9. An arrangement as claimed in claim 8 wherein the fence comprises a curved portion to turn the leakage flow in a radial direction.

10. An arrangement as claimed in claim 1 wherein the wall incorporates a plurality of paths.

11. An arrangement as claimed in claim 1 wherein the cavity includes a coolant bleed aperture.

12. An arrangement as claimed in claim 1 wherein the path includes an exit away from the coolant bleed aperture.

13. An arrangement as claimed in claim 1 wherein the path extends laterally across the wall.

14. An arrangement as claimed in claim 1 wherein the nozzle opening is part of a nozzle to provide swirl for a coolant flow in use.

15. An arrangement as claimed in claim 1 wherein the wall forms part of an engine core.

16. A gas turbine engine including a flow cavity arrangement as claimed in claim 1.

* * * * *